United States Patent [19]

Edler

[11] Patent Number: 4,547,680

[45] Date of Patent: Oct. 15, 1985

[54] FLUID FLOW MACHINE WITH AN ELECTROMAGNETICALLY OPERATED DIAPHRAGM PUMP

[75] Inventor: Friedrich Edler, Bammental, Del.X

[73] Assignee: Chemie Und Filter GmbH, Verfahrenstechnik KG, Heidelberg, Fed. Rep. of Germany

[21] Appl. No.: 462,373

[22] Filed: Jan. 31, 1983

[30] Foreign Application Priority Data

Feb. 6, 1982 [DE] Fed. Rep. of Germany ..... 3204050

[51] Int. Cl.[4] ..... F04B 49/00

[52] U.S. Cl. ..... 307/141; 307/118; 340/606; 417/18

[58] Field of Search ..... 307/115, 118, 132 E, 307/132 EA, 141; 340/606, 609; 361/178; 417/18, 20

[56] References Cited

U.S. PATENT DOCUMENTS 3,966,358 6/1976 Heimes et al. ..... 417/18 X 4,190,829 2/1980 Schmitt et al. ..... 340/606

4,353,118 10/1982 Heimgartner et al. ..... 340/606 X

*Primary Examiner*—Reinhard J. Eisenzopf

*Assistant Examiner*—Derek S. Jennings

*Attorney, Agent, or Firm*—Peter K. Kontler

[57] ABSTRACT

A diaphragm pump wherein the diaphragm is deformable by the reciprocable armature of an electromagnet which is energizable at a selected frequency by a timer circuit and at random frequency by a pulse generator. The pulse generator is connectable with the electromagnet by a cable having separable male and female coupling elements which automatically deactivate the timer circuit when the male coupling element is inserted into the female coupling element. A selector switch is provided to deactivate the timer circuit independently of the coupling elements. A knob serves to adjust a potentiometer of the timer circuit simultaneously with closing of the selector switch so that the frequency at which the timer circuit can energize the electromagnet is reduced to a minimum value.

17 Claims, 2 Drawing Figures

FLUID FLOW MACHINE WITH AN ELECTROMAGNETICALLY OPERATED DIAPHRAGM PUMP

CROSS-REFERENCE TO RELATED CASES

Fluid flow machines wherein the motor for the pump can be controlled in accordance with the present invention are disclosed, for example, in commonly owned copending U.S. patent application Ser. No. 459,790 filed Jan. 21, 1983 by Michael Wally for "Diaphragm pump for use in an explosive atmosphere" and in the commonly owned copending U.S. patent application Ser. No. 459,785 filed Jan. 21, 1983 by Michael Wally for "Diaphragm pump".

BACKGROUND OF THE INVENTION

The present invention relates to fluid flow machines in general, and more particularly to improvements in fluid flow machines of the type wherein an axial piston pump is operated by an electromagnet, especially to improvements in fluid flow machines wherein the axial piston pump is a diaphragm pump.

It is already known to construct a fluid flow machine, wherein a diaphragm pump is operated by an electromagnet, in such a way that the electromagnet can be energized by two different energizing devices. Reference may be had to fluid flow machines which are distributed by the assignee of the present application under the designation "ProMinet"(trademark). The arrangement is such that the electromagnet can be energized by a timer circuit (internal operation) or by a pulse generator (external operation) which is connectable to the fluid flow machine by a separable coupling including a plug and a socket for the plug. The extent or reciprocatory movement of the armature of the electromagnet determines the quantity of fluid which is conveyed by the pump in response to each energization of the electromagnet. The stroke of the armature is adjustable so that an attendant can select the quantity of fluid which is conveyed by the pump whenever the electromagnet is energized so that its armature performs a forward and a return stroke. When the fluid flow machine is set for internal operation, the timer circuit energizes the electromagnet at a selected frequency so that the pump delivers a constant (but variable) quantity of fluid per unit of time. If the fluid flow machine is converted for external operation, the aforementioned pulse generator can initiate the energization of the electromagnet at a frequency which is regular or irregular, e.g., as a function of one or more variable parameters, depending on the intended use of the fluid which is conveyed by the pump. For example, the pulse generator can energize the electromagnet at a frequency which is a function of the rate of fluid flow in a pipe wherein such rate is monitored by a flow measuring device serving to transmit signals to the pulse generator. The means for converting the fluid flow machine from internal operation to external operation or vice versa comprises a selector switch which is actuated by the person in charge.

A drawback of the just discussed fluid flow machine is that the conversion from external operation to internal operation is not foolproof. For example, it can happen that, when an attendant wishes to shift from internal operation to external operation, the attendant properly attaches the male connector (plug) of the aforementioned coupling to the female connector (socket) but the attendant forgets to change the position of the selector switch so that the electromagnet continues to be energized at a frequency which is determined by the timer circuit rather than at a frequency which is dependent on the pulse generator and the associated flow measuring device. Consequently, the body of liquid whose flow is measured receives metered quantities of a fluid medium at a frequency which is not dependent on the rate of liquid flow past the measuring device. This can create serious problems, especially if the liquid whose flow is measured is drinking water and the pump is designed to admit thereto certain chemicals which, if ingested in excessive quantities, can be harmful to the consumers.

OBJECTS AND SUMMARY OF THE INVENTION

An object of the invention is to provide a novel and improved fluid flow machine wherein the electromagnet for the pump can be energized in several different ways and which is constructed and assembled with a view to ensure that accidental energization of the electromagnet in an undesirable or improper manner is much less likely than in heretofore known machines.

Another object of the invention is to provide a fluid flow machine, especially a machine wherein the electromagnet operates an axial piston pump (such as a diaphragm pump), which is constructed is such a way that the conversion from one mode of energization of the electromagnet to another mode of energization necessitates several manipulations which prevent energization at a constant frequency when a random-frequency energization is required or desired, or vice versa.

A further object of the invention is to provide a novel and improved method of manipulating a fluid flow machine wherein the pump is operable by an electromagnet and the electromagnet is energizable in a plurality of different ways.

An additional object of the invention is to provide a novel control circuit for use in a fluid flow machine of the above outlined character.

Another object of the invention is to provide a fluid flow machine of the above outlined character wherein the conversion from one mode to another mode of energizing the electromagnet for the pump takes up little time in spite of the fact that such conversion is much less likely to lead to improper mode of energizing than in heretofore known fluid flow machines.

An additional object of the invention is to provide the fluid flow machine with novel and improved means for automatically and reliably terminating the energization of the electromagnet in one of several possible ways when the operator has decided to energize the electromagnet in another way.

A further object of the invention is to provide a control circuit which can be used in a fluid flow machine of the above outlined character and which is more versatile but not more complex than the heretofore known control circuits.

The invention is embodied in a fluid flow machine, especially a fluid flow machine with an axial piston pump which is a diaphragm pump. The machine comprises a pump, electromagnet means for operating the pump, first and second energizing means which are activatable to energize the electromagnet means, means for activating the first energizing means including coupling means having first and second coupling elements which are separable from one another to thereby deactivate the first energizing means, and means for blocking or preventing the activation of the second energizing means in response to connection of the coupling elements to one another. The machine preferably further comprises adjustable selector means (e.g., a switch having a first contact which is movable into and from engagement with a second contact) which is adjustable to prevent activation of the second energizing means independently of the blocking means. The second energizing means can comprise a timer circuit which is designed to energize the electromagnet means at timely spaced intervals when the coupling elements are separated from one another. The timer circuit is preferably adjustable by an adjusting device which also serves to adjust the selector means; for example, the adjusting device can move the aforementioned movable contact to closed position, in which the second energizing means is deactivated, simultaneously with movement of a movable portion of a potentiometer in the timer circuit to an extreme position, namely, to a position in which the timer circuit reduces the frequency of energization of the electromagnet means to a minimum value.

The first and second energizing means can respectively comprise first and second trigger circuits each of which has an input and an output connectable with the electromagnet means. The first energizing means can further comprise a pulse generator serving to transmit signals to the input of the first trigger circuit when the coupling elements are connected to one another. The timer circuit has a tap which is connected with the input of the second trigger circuit and serves to transmit signals to such input when the coupling elements are separated from one another.

The machine can further comprise a source of blocking potential (e.g., a zero-potential lead) and each of the coupling elements preferably further comprises a first, a second and a third terminal. The terminals of the first coupling element engage the corresponding terminals of the second coupling element when such coupling elements are attached to one another. The first and second terminals of the two coupling elements connect the pulse generator with the input of the first trigger circuit and the third terminals connect the zero-potential lead to the input of the second trigger circuit when the two coupling elements are attached to one another. The third terminals can be said to constitute or to form part of the blocking means.

The timer circuit preferably comprises resistor means in series with capacitor means which latter is chargeable via the resistor means to energize the electromagnet means. The blocking means includes means (such as the aforementioned third terminals of the coupling elements) for shunting or bypassing the capacitor means in response to attachment of the coupling elements to one another. The input of the second trigger circuit is connected with one plate of the capacitor means and the blocking means applies zero potential to the input of the second trigger circuit in response to attachment of the first and second coupling elements to one another. The switch of the aforementioned selector means is adjustable to apply zero potential to the input of the second trigger circuit in response to closing of the switch by the aforementioned common adjusting means for such switch and the adjustable portion of the potentiometer in the timer circuit. The shunting means can further comprise conductor means which connects one plate of the capacitor means with the input of the second trigger circuit, with the wire of the potentiometer, with the second contact of the switch, and with the third terminal of one of the coupling elements. The third terminal of the other coupling element connects the third terminal of the one coupling element with the source of zero potential when the two coupling elements are attached to one another. To this end, the second terminal of the one coupling element is permanently connected with the source of zero potential and is also connected with the second terminal of the other coupling element when such elements are attached to each other, and the second terminal of the other coupling element is electrically connected with the third terminal, e.g., by a fixed bridge.

The pump (or at least a portion of the pump), the electromagnet means, at least one of the two energizing means and even a portion of the blocking means can be installed in a common housing. The coupling means is preferably installed externally of the housing.

The novel features which are considered as characteristic of the invention are set forth in particular in the appended claims. The improved fluid flow machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
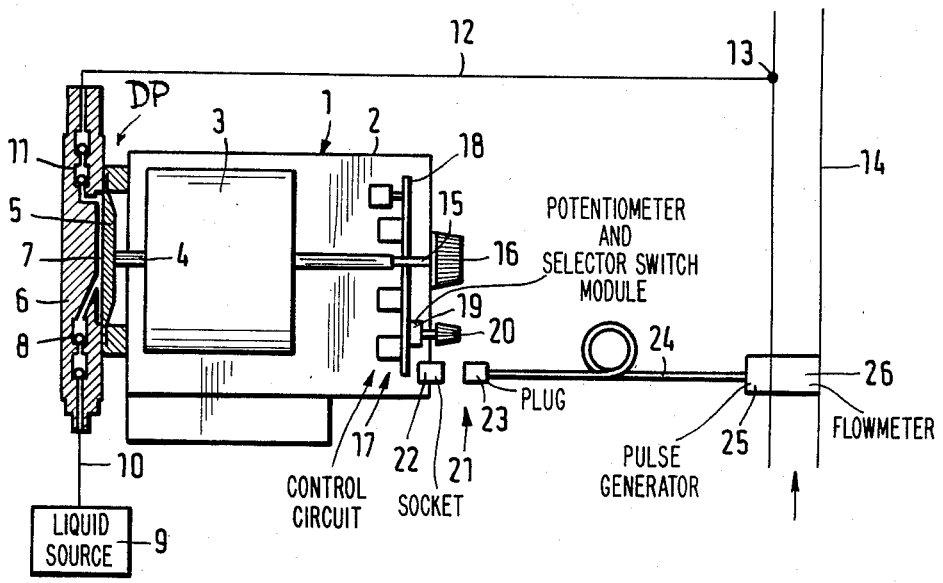
FIG. 1 is a schematic elevational view of a fluid flow machine which embodies the invention, the parts of the machine being shown in the positions they assume when the electromagnet means is energizable by the second energizing means which includes a timer circuit.

The fluid flow machine 1 which is shown in FIG. 1 comprises an axial piston pump here shown as a diaphragm pump DP and an electromagnet 3 which operates the pump DP when necessary. The reference character 2 denotes a common housing or casing for the pump DP and the electromagnet 3. The armature of the electromagnet 3 can reciprocate a plunger 4 which transmits motion to the axial piston 5 of the pump DP. The piston 5 is a deformable diaphragm which can draw a liquid from a source 9 into a pumping chamber 7 provided in the head 6 of the pump DP whenever the plunger 4 performs a rightward stroke, as viewed in FIG. 1. The source 9 is connected with the pumping chamber 7 by a suction conduit 10 which contains one or more suction valves 8. Reference may be had to the aforementioned commonly owned copending U.S. patent applications Ser. Nos. 459,785 and 459,790 for the details of construction of the pump DP, electromagnet 3, means for supplying liquid into the chamber 7 and means for evacuating metered quantities of liquid from the chamber 7 when the plunger 4 performs a stroke in a direction to the left, as viewed in FIG. 1, in order to reduce the volume of the pumping chamber 7. The latter then discharges a metered quantity of liquid by way of a pressure conduit 12 which contains one or more pressure valves 11 and discharges into the inlet 13 of a pipe 14. For example, the pipe 14 can convey a continuous stream of drinking water, and the inlet 13 can admit metered quantities of a sterilizing agent, an anticorrosion medium or the like.

Figure 2:
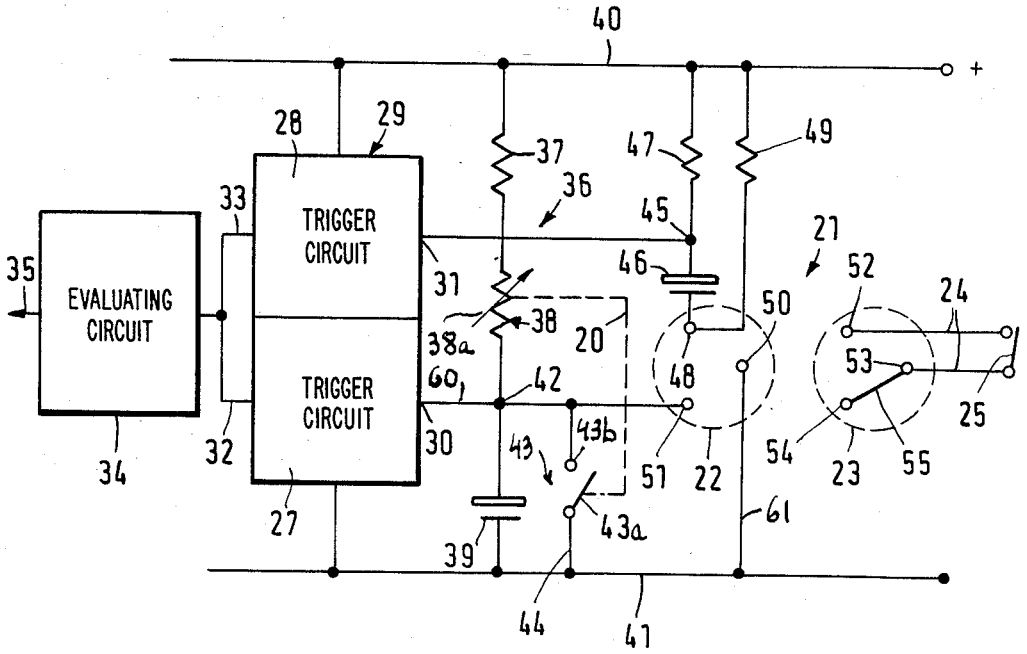
FIG. 2 is a diagram of the control circuit which can energize the electromagnet means in response to signals from the timer circuit or from the first energizing means which includes a pulse generator responding to signals generated by a fluid flow measuring device.

The stroke of the plunger 4, and hence the rate at which the pump DP draws liquid from the source 9 into the chamber 7 and discharges liquid from the chamber 7 into the pipe 14, can be regulated by an adjustable stop 15 whose axial position can be changed by a stroke adjusting knob 16 which is accessible at the rear side of the housing 2. The latter further accommodates a control circuit 17 including a panel 18 serving to support various components or modules of the control circuit. The just mentioned components include a module 19 including an adjustable potentiometer 38 (FIG. 2) and a two-position selector switch 43 (FIG. 2) which can be adjusted by a common adjusting or actuating device 20 in the form of a knob which is adjacent to the aforementioned knob 16. The arrangement is such that the movable portion or wiper 38*a* of the potentiometer 38 must be moved to one of its two extreme or end positions before the movable contact 43*a* of the selector switch 43 is moved from the illustrated open position to a closed position in which it engages a fixed contact 43*b*. The potentiometer 38 forms part of a timer circuit 36 which, in turn, forms part of one of the two means for energizing the electromagnet 3 in order to reciprocate the plunger 4 at one of a number of different frequencies. The other energizing means for the electromagnet 3 comprises a pulse generator 25 which is mounted externally of the housing 2 and can receive signals from a liquid flow measuring device 26 in the pipe 14. The pulse generator 25 can be connected with the control circuit 17 to energize the electromagnet 3 at intervals which are determined by the flow measuring device 26 in response to establishment of a connection between the female and male elements (e.g., a conventional socket and a conventional plug) 22 and 23 of a separable plug-in coupling 21 whose male element 23 is connected to the output of the pulse generator 25 by a two-conductor cable 24.

The control circuit 17 further includes two trigger circuits 27, 28 which together constitute an IC module 29 of the type known as a thick film circuit. The trigger circuits 27, 28 respectively comprise inputs 30, 31 and outputs 32, 33. The outputs 32, 33 are connected with the input of a conventional evaluating circuit 34 having an output 35 serving to transmit energizing signals to the electromagnet 3 in response to the application of appropriate signals to the input 30 or 31. The exact nature of the trigger circuits 27, 28 and/or evaluating circuit 34 forms no part of the present invention. The trigger circuit 28 and the parts 24–26 constitute a first energizing unit, and the trigger circuit 27 and the timer circuit 36 constitute a second energizing unit for the electromagnet 3.

The timer circuit 36 includes a first resistor 37 in series with a second resistor, namely, the aforementioned adjustable potentiometer 38, and a capacitor 39. The timer circuit 36 is connected between a positive bus bar 40 and a zero-potential lead 41. The input 30 is connected with a tap 42 between the potentiometer 38 and the capacitor 39. As mentioned above, the potentiometer 38 forms part of the module 19 which further includes the selector switch 43. The switch 43 and the conductors 44 and 60 constitute a means for shunting or bypassing the capacitor 39 of the timer circuit 36 when the latter is inactive because the electromagnet 3 is to be energized by the pulse generator 25 via cable 24, coupling 21 and trigger circuit 29. Closing of the selector switch 43 results in the application of zero or blocking potential to the tap 42 and hence to the input 30 of the trigger circuit 27.

The input 31 of the trigger circuit 28 is connected with a tap 45 between a resistor 47 and a capacitor 46. The capacitor 46 is connected in series with the resistor 47 and the latter is connected in parallel with a further resistor 49. The series-connected elements 46, 47 are connected between the bus bar 40 and the first (48) of three terminals 48, 50, 51 of the female coupling element 22 of the coupling 21. The resistor 49 is connected between the terminal 48 and the bus bar 40. The second terminal 50 of the coupling element 22 is connected with the zero-potential lead 41, and the third terminal 51 of the coupling element 22 is connected to the tap 42, to the input 30 and to the stationary contact 43*b* of the selector switch 43.

The first two terminals 52 and 53 of the coupling element 23 of the coupling 21 are connected with the pulse generator 25 by the conductors of the cable 24. The third terminal 54 of the coupling element 23 is connected to the second terminal 53 by a fixed bridge 55. When the coupling element 23 is inserted into the coupling element 22, the terminals 52, 53, 54 of the element 23 respectively engage the terminals 48, 50, 51 of the element 22. The terminal 50 is connected to the lead 41 by a further conductor 61.

The operation is as follows:

The drawing shows the fluid flow machine 1 in a condition when the electromagnet 3 is energized at a frequency which is selected by the potentiometer 38 in the timer circuit 36, i.e., when the evaluating circuit 34 of the control circuit 17 receives signals from the output 32 of the trigger circuit 27 and the input 30 of the trigger circuit 27 receives signals from the tap 42. The coupling element 23 of the coupling 21 is disconnected from the coupling element 22 so that the pulse generator 25 cannot influence the energization of the electromagnet 3, and the selector switch 43 is open because the wiper 38*a* of the potentiometer 38 is held in a position other than the aforementioned extreme position (in which the frequency of signal transmission to the input 30 of the trigger circuit 27 is reduced to the minimum value). The rate at which capacitor 39 is charged via resistor means, 37, 38 depends on the adjustment of the wiper 38*a*. When its charge reaches a predetermined value, the capacitor 39 discharges via tap 42 and the input 30 of the trigger circuit 27 receives a signal which cause the output 32 to effect the generation of a signal which is transmitted to the electromagnet 3 via output 35 of the evaluating circuit 34. The charging of capacitor 39 begins anew whenever the input 30 receives a signal via tap 42.

If the operator wishes to switch from energization of the electromagnet 3 by the timer circuit 36 at a frequency which is determined by the position of the wiper 38*a* (i.e., by the position of the knob 20 which constitutes a common actuating or adjusting means for the potentiometer 38 and the selector switch 43), it is necessary to close the selector switch 43 as well as to attach the male coupling element 23 of the coupling 21 to the female coupling element 22. This automatically deactivates the timer circuit 36 because the tap 42 and the inlet 30 receive zero potential from the lead 41 via conductors 44, 60 and closed selector switch 43 as well as via lead 41, conductor 61, terminal 50 of the female coupling element 22, terminal 53 of the male coupling element 23, fixed bridge 55 of the male coupling element, terminal 54 of the male coupling element and terminal 51 of the female coupling element. If the normally open switch of the pulse generator 25 is thereupon closed by the flow measuring device 26, the potential at the tap 45 decreases for a short interval of time whereby the input 31 of the trigger circuit 28 receives a signal which causes its output 33 to effect the transmission of a signal from the output 35 of the evaluating circuit 34 to the electromagnet 3 which is energized and causes a metered quantity of liquid to flow from the pumping chamber 7 in the head 6 of the diaphragm pump DP into the pipe 14.

It will be noted that the conversion from operation with the timer circuit 36 to operation with the pulse generator 25 and flow measuring device 26 normally involves two manipulations, namely, closing of the selector switch 43 and attachment of the male coupling element 23 of the coupling 21 to the female coupling element 22. The operation with either the timer circuit 36 or pulse generator 25 is automatic; the difference is that the frequency of energization of the electromagnet 3 by the timer circuit 36 is determined by the selected position of the wiper 38*a* whereas the frequency of energization of the electromagnet 3 by the pulse generator 25 is dependent on the requirements of the stream of liquid flowing in the pipe 14, i.e., on the rate of liquid flow past the flow measuring device 26. The provision of two manipulations in order to convert from energization by timer circuit 36 to energization via pulse generator 25 is an advantageous feature of the improved fluid flow machine 1 because this ensures that the energization by timer circuit 36 cannot be started accidentally, e.g., due to an error.

As mentioned above, the improved fluid flow machine 1 can be used for a wide variety of purposes. The nature of the fluid which is supplied by the source 9 can be selected practically at will and depends on the nature of fluid in the conduit 14, the nature of the pipe 14, the intended use of the fluid flowing in the pipe 14 and/or certain other parameters. Thus, and as also mentioned above, the source 9 can contain a supply of sterilizing, disinfecting or similar agent which is to be admitted into the fluid stream in the pipe 14 at a predetermined frequency irrespective of variations of the rate of flow of fluid in the pipe 14, or at a frequency which is determined by the rate of fluid flow in the pipe 14. If the fluid in the pipe 14 is drinking water, the source 9 can contain a sterilizing agent or an agent which reduces the likelihood or prevents corrosion of the material of the pipe 14 and/or conduit 10 and/or conduit 12. Furthermore, the frequency at which the pulse generator 25 energizes the electromagnet 3 via coupling 21 and trigger circuit 28 need not necessarily depend on the rate of fluid flow past the measuring device 26. For example, the pulse generator 25 can be responsive to signals denoting the concentration of one or more ingredients of fluid in the pipe 14, or the pH of the fluid, or the redox-value of the fluid and/or others.

An important advantage of the improved fluid flow machine is that the likelihood of energizing the electromagnet 3 at an improper frequency is practically nil. This is due to the fact that the (internal) operation with the timer circuit 36 is impossible as soon as the element 23 of the coupling 21 is inserted into the element 22 because the terminals 50, 51, 53, 54 then cooperate with the bridge 55 to connect the tap 42 and the input 30 with the zero-potential lead 41 irrespective of the position of the selector switch 43. In order to make sure that the input 31 can receive signals from the pulse generator 25 at a frequency which is determined by the flow measuring device 26, it is not even necessary to move the knob 20 to an angular position in which the selector switch 43 is closed because the potential at the tap 42 and input 30 is zero as soon as the element 23 is inserted into the element 22.

On the other hand, the attendant is compelled to carry out two discrete operations before the conversion from external operation to internal operation is completed. This will be readily appreciated since if the attendant has closed the selector switch 43 and has also coupled the element 23 to the element 22 in order to ensure that the electromagnet 3 will be energized by the flow measuring device 26, conversion to internal operation necessitates disengagement of the element 23 from the element 22 as well as opening of the selector switch 43 because the knob 20 is used to open or close the switch 43 as well as to select the position of the wiper 38*a* and hence the frequency at which the timer circuit 36 is to energize the electromagnet 3.

While it is possible that the element 23 will be accidentally detached or separated from the element 22 to thus terminate the external operation, it is much less likely that such accidental separation of the male and female elements 23, 22 of the coupling 21 will take place simultaneously with accidental opening of the selector switch 43. By the same token, while it is possible that the attendant will accidentally or mistakenly move the selector switch 43 to open position while the element 23 is connected to the element 22, it is much less likely that the placing of movable contact 43*a* of the switch 43 to improper or undesirable position will take place simultaneously with separation of the coupling element 23 from the coupling element 22. Thus, the likelihood of internal operation at a time when external operation is desirable or necessary is extremely remote, and certainly much more remote than in heretofore known fluid flow machines wherein the attachment or detachment of the male coupling element to or from the female coupling element cannot and does not influence the internal operation, i.e., where the changeover from internal operation to external operation or vice versa is effected exclusively in response to actuation of a selector switch.

The provision of a common actuating or adjusting knob 20 for the wiper or the potentiometer 38 as well as for the selector switch 43 constitutes an optional but highly desirable and advantageous feature of the improved control circuit 17. As mentioned above, the arrangement is preferably such that the wiper 38*a* must be moved outside of its range of adjustments for the purpose of selecting a desired frequency of energization during internal operation before the switch 43 is closed. The provision of a common actuating means (20) for the selector switch 43 and wiper 38*a* eliminates the need for a discrete second actuating device. This is of particular importance when the control circuit 17 is installed in a housing 2 which is sealed in a manner and for the purposes as disclosed in the aforementioned copending patent applications of Wally. Thus, if the housing 2 is to be capable of preventing the propagation of ignition from its interior to the surrounding atmosphere, elimination of the need for one or more additional externally mounted actuating devices for modules or other parts of the circuit in the interior of the housing 2 represents a substantial saving in intial cost as well as a reduction of the risk of explosion. The possibility that a careless or inexperienced attendant will fail to close the selector switch 43 via knob 20 preparatory to start of external operation is of no consequence because the function of the switch 43 is also performed by the blocking means in the coupling 21, i.e., the input 30 of the trigger circuit 27 which cooperates with the timer circuit 36 is connected to the zero-potential lead 41 in automatic response to insertion of the coupling element 23 into the coupling element 22. In other words, mere establishment of proper connections between the terminals 48, 50, 51 on the one hand and the terminals 52, 53, 54 on the other hand suffices to prevent internal operation irrespective of the angular position of the knob 20.

As also mentioned above, closing of the selector switch 43 preferably takes place not before the wiper 38*a* is moved to or beyond an extreme of end position in which the frequency of energization of the electromagnet 3 via trigger circuit 27 and timer circuit 36 is reduced to a minimum. This ensures that, when the attendant disengages the coupling element 23 from the coupling element 22, internal operation cannot proceed with energization of the electromagnet 3 at a high or very high frequency (provided, of course, that the attendant has moved the switch 43 to closed position preparatory to or during conversion to external operation) because the resistance of the potentiometer 38 is either excessive or sufficiently high to prevent frequent energization of the electromagnet 3 per unit of time. The absence of energization at a required frequency is detected and the attendant than adjusts the knob 20 and the wiper 38*a* until the actual energizing frequency matches the desired or optimum frequency. Adjustments of the stroke of the plunger 4 (via knob 16) can be carried out irrespective of whether the operation is internal or external.

The provision of terminals 51, 54, bridge 55 and conductor means 61 connecting the lead 41 with the terminal 53 when the coupling element 23 is inserted into the coupling element 22 constitutes a simple but highly effective mode of ensuring that the tap 42 and the input 30 are connected with the lead 41 as soon as the coupling 21 is effective to connect the flow measuring device 26 with trigger circuit 28. It will be noted that the tap 42 is connected with the input 30, with one plate of the capacitor 39, with the wire of the potentiometer 38, with the fixed contact 43*b* of the switch 43 as well as with the terminal 51 of the coupling element 22. Insertion of the coupling element 23 into the coupling element 22 results in automatic establishment of an electrical connection between the lead 41 and the tap 42 via conductor 61, terminals 50, 53, bridge 55, terminals 54, 51 and conductor 60. Such arrangement contributes to simplicity of the control circuit 17. The bridge 55 could be replaced with a switch which closes in automatic response to insertion of the coupling element 23 into the coupling element 22. However, the fixedly mounted bridge 55 is preferred at this time because it contributes to simplicity and reliability of the circuit.

The trigger circuits 27, 28 may be of the type known as NE 555, manufactured by Singetics, and the evaluating circuit 34 may be of the type MP 240 D 3, manufactured by Opto 22.

Without further analysis, the foregoing will so fully reveal the gist of the present invention that others can, by applying current knowledge, readily adapt if for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A fluid flow machine, comprising a pump; electromagnet means for operating said pump; first and second energizing means activatable to energize said electromagnet means, said second energizing means comprising a timer circuit including resistor means and capacitor means in series with said resistor means, said capacitor means being chargeable via said resistor means to thereby energize said electromagnet means; means for activating said first energizing means, including coupling means having first and second coupling elements which are separable from each other to thereby deactivate said first energizing means; and means for blocking the activation of said second energizing means in response to connection of said coupling elements to each other, said blocking means including means for shunting said capacitor means in response to attachment of said coupling elements to one another.

2. The machine of claim 1, further comprising selector means which is adjustable to prevent activation of said second energizing means independently of said blocking means.

3. The machine of claim 1, wherein said pump is a diaphragm pump.

4. The machine of claim 1, further comprising a common housing for said pump, said electromagnet means, at least one of said energizing means and a portion of said blocking means.

5. The machine of claim 4, wherein said coupling means is disposed externally of said housing.

6. A fluid flow machine, comprising a pump; electromagnet means for operating said pump; first and second energizing means activatable to energize said electromagnet means, said second energizing means including adjustable timer means, and said timer means comprising a potentiometer having a portion which is movable to and from an extreme position; means for activating said first energizing means, including coupling means having first and second coupling elements which are separable from each other to thereby deactivate said first energizing means, said timer means being arranged to energize said electromagnet means at timely spaced intervals when said coupling elements are separated from one another; means for blocking the activation of said second energizing means in response to connection of said coupling elements to each other; selector means adjustable to prevent activation of said second energizing means independently of said blocking means, said selector means including a switch having a portion which is movable to and from a closed position in which said second energizing means is deactivated; and common adjusting means for said selector means and said timer means, said common adjusting means including means for moving said portion of said potentiometer to said extreme position simultaneously with movement of said portion of said switch to closed position.

7. The machine of claim 6, wherein said timer means is arranged to reduce the frequency of energization of said electromagnet means to a minimum value when said portion of said potentiometer assumes said extreme position.

8. A fluid flow machine, comprising a pump; electromagnet means for operating said pump; first and second energizing means activatable to energize said electromagnet means, said first and second energizing means respectively including first and second trigger circuits each having an input and an output which latter is connectable with said electromagnet means; means for activating said first energizing means, including coupling means having first and second coupling elements which are separable from each other to thereby deactivate said first energizing means, said first energizing means comprising a pulse generator arranged to transmit signals to the input of said first trigger circuit when said coupling elements are connected to each other, and said second energizing means comprising timer means for transmitting signals to the input of said second trigger circuit when said coupling elements are separated from one another; and means for blocking the activation of said second energizing means in response to connection of said coupling elements to each other.

9. The machine of claim 8, further comprising a source of blocking potential, each of said coupling elements comprising a first, a second and a third terminal, and the terminals of said first coupling element engaging the corresponding terminals of said second coupling element in response to attachment of such coupling elements to one another, the first and second terminals of said coupling elements being arranged to connect said pulse generator with the input of said first trigger circuit, and the third terminals of said coupling elements forming part of said blocking means and being arranged to connect said source with the input of said second trigger circuit.

10. The machine of claim 9, wherein said blocking potential is zero potential.

11. A fluid flow machine, comprising a pump; electromagnet means for operating said pump; first and second energizing means activatable to energize said electromagnet means, said second energizing means including a timer circuit which comprises resistor means, and capacitor means in series with said resistor means, said capacitor means being chargeable via said resistor means to thereby energize said electromagnet means, and said second energizing means further including a trigger circuit having an input connected with said capacitor means, and an output connectable with said electromagnet means; means for activating said first energizing means, including coupling means having first and second coupling elements which are separable from each other to thereby deactivate said first energizing means; and means for blocking the activation of said second energizing means in response to connection of said coupling elements to each other, said blocking means including means for shunting said capacitor means in response to attachment of said coupling elements to one another, and said shunting means including means for applying a blocking potential to the input of said trigger circuit in response to attachment of said coupling elements to one another.

12. The machine of claim 11, further comprising selector means operable to apply blocking potential to said input independently of said shunting means.

13. The machine of claim 12, wherein said selector means includes a switch and said resistor means includes a potentiometer having a adjustable portion; and further comprising means for actuating said switch and for simultaneously adjusting said potentiometer.

14. The machine of claim 13, wherein said shunting means includes conductor means connecting said input with one plate of said capacitor means and with one contact of said switch, said switch further having another contact arranged to apply blocking potential to said input in response to engagement with said one contact and said coupling elements including terminals arranged to apply blocking potential to said conductor means and hence to said input in response to attachment of said coupling elements to one another.

15. The machine of claim 14, further comprising a source of blocking potential connected with the other contact of said switch and with one terminal of one of said coupling elements, another terminal of said one coupling element being connected with said conductor means, and the terminals of the other of said coupling elements being arranged to electrically connect said one terminal to said other terminal in response to attachment of said coupling elements to one another.

16. The machine of claim 15, wherein said other coupling element includes first and second terminals which respectively engage said one and said other terminal of said one coupling element when said coupling elements are attached to one another, said other coupling element further comprising means for electrically connecting said first and second terminals with one another.

17. The machine of claim 16, wherein said connecting means includes a bridge extending between said first and second terminals.

* * * * *